US007560015B2

(12) United States Patent
Stilli

(10) Patent No.: US 7,560,015 B2
(45) Date of Patent: Jul. 14, 2009

(54) PROCESS FOR ELECTROLYTIC COATING OF A STRAND CASTING MOULD

(75) Inventor: Adrian Stilli, Bulach (CH)

(73) Assignee: Concast AG, Zurich (CH)

( * ) Notice: Subject to any disclaimer, the term of this patent is extended or adjusted under 35 U.S.C. 154(b) by 467 days.

(21) Appl. No.: 10/997,746

(22) Filed: Nov. 24, 2004

(65) Prior Publication Data

US 2005/0167276 A1 Aug. 4, 2005

Related U.S. Application Data

(63) Continuation-in-part of application No. PCT/EP03/05238, filed on May 19, 2003.

(30) Foreign Application Priority Data

May 27, 2002 (CH) ..... 0876/02

(51) Int. Cl.
*C25D 11/00* (2006.01)
*C25D 5/02* (2006.01)

(52) U.S. Cl. ..... 205/107; 205/131; 205/205; 205/83; 205/91; 205/96; 205/105; 205/84; 205/106; 205/147; 205/158; 205/162; 205/118; 205/159

(58) Field of Classification Search ..... 205/131, 205/205, 83, 91, 96, 105, 84, 106, 147, 158, 205/162, 118, 159, 107
See application file for complete search history.

(56) References Cited

U.S. PATENT DOCUMENTS 3,582,477 A * 6/1971 Gelb et al. ..... 205/89
4,952,290 A * 8/1990 Carnarius et al. ..... 205/99
5,496,463 A 3/1996 Mori et al.

(Continued)

FOREIGN PATENT DOCUMENTS

DE 29 36 177 A1 5/1981

(Continued)

OTHER PUBLICATIONS

Patent Abstracts of Japan; vol. 012, No. 343, Sep. 14, 1988 & JP 63 104752 A (Sumitomo Metal Ind Ltd; Others:01), May 10, 1998.

(Continued)

*Primary Examiner*—Harry Wilkins
*Assistant Examiner*—Zulmariam Mendez
(74) *Attorney, Agent, or Firm*—Darby & Darby P.C.

(57) ABSTRACT

Apparatus and method for electrolytic coating of a mould, the internal surfaces of which demarcate a mould cavity, with a coating material for the purpose of achieving or re-achieving intended mould cavity dimensions. The mould, as the cathode, and an anode positioned in the mould cavity and an electrolyte containing the coating material are used. The electrolyte serving as the carrier of the coating material flows through the mould cavity in a controlled manner. During the electrolytic coating, only the internal surfaces of the mould cavity come into contact with the electrolyte and the external surfaces of the s mould therefore do not have to be covered. The mechanical properties can be kept largely uniform over the entire region. The coating can be achieved more rapidly than with the conventional processes.

16 Claims, 1 Drawing Sheet

U.S. PATENT DOCUMENTS

| | | | | |
|---|---|---|---|---|
| 5,527,445 | A * | 6/1996 | Palumbo et al. | 205/103 |
| 5,647,967 | A * | 7/1997 | Murase et al. | 205/131 |
| 5,667,662 | A * | 9/1997 | Sonnenberg et al. | 205/162 |
| 5,783,058 | A * | 7/1998 | Fowler et al. | 205/205 |
| 6,228,242 | B1 | 5/2001 | Lavelaine et al. | |
| 6,383,348 | B2 * | 5/2002 | Kuroda et al. | 204/237 |

FOREIGN PATENT DOCUMENTS

| | | | |
|---|---|---|---|
| FR | 2 806 098 | A1 | 9/2001 |

OTHER PUBLICATIONS

Patent Abstracts of Japan; vol. 009, No. 311, Dec. 7, 1985 & JP 60 145247 A (Kawasaki Seitetsu KK; Others: 01), Jul. 31, 1985.

Patent Abstracts of Japan; vol. 014, No. 171, Apr. 3, 1990 & JP 02 022495 A (Mitsubishi Heavy IND LTD), Jan. 25, 1990.

Patent Abstracts of Japan; vol. 006, No. 058, Apr. 15, 1982 & JP 57 001543 A (Kawasaki Steel Corp; Others:01), Jan. 6, 1982.

* cited by examiner

PROCESS FOR ELECTROLYTIC COATING OF A STRAND CASTING MOULD

This application is a continuation-in-part of PCT Application No. PCT/EP03/05238, having an International filing date of Mar. 19, 2003, which is incorporated by reference herein in its entirety.

BACKGROUND OF THE INVENTION

1. Field of the Invention

The invention relates to a process for electrolytic coating of a strand casting mould.

2. Description of Related Art

Strand casting moulds are subject to a constant abrasive wear during casting, so that the mould cavity and therefore also the cross-section dimensions of the cast strands become ever larger. After a certain number of working cycles, the particular strand casting mould must therefore be replaced by a new one or reworked.

Various methods for reworking the moulds for the purpose or re-establishing the original geometry of the mould cavity or the intended dimensions of the mould cavity are known. Reworking can be carried out, for example, by explosion forming of the mould on a mandrel. Not only is this method relatively complicated, expensive and environment-polluting, it also means a deformation of the external shape of the mould, which in turn involves an enlargement of a water gap present on the periphery of the mould and as a result an adverse influence on the cooling of the mould. Other known pressing processes for reshaping the moulds in which the mould is first compressed from the outside and the mould cavity is then brought to the original internal dimensions by internal grinding or internal milling also have the latter disadvantage.

Finally, it is known from EP-A-0 282 759 to bring the mould cavity of a strand casting mould back to the intended dimensions by electrolytic coating of the internal surfaces which demarcate the mould cavity. In this generic process, the mould, which serves as the cathode, is immersed in an electrolyte bath (Cu sulfate bath) together with a perforated anode basket which is positioned in the mould cavity and is filled with soluble copper pieces (cubes, balls, discs). When a direct current is connected, the copper is separated out of the electrolyte bath and deposited on the mould surfaces, the copper separated out of the electrolyte bath being replaced by the dissolved anode copper. A relatively low current density, for example of about 15 A/dm$^2$, is achieved in this dipping electrolytic process. From experience, in the case of electrolytic dip-coating of mould cavities which are usually polygonal in cross-section there is the risk that the layer is of insufficient thickness in the corner regions, that is to say the layer thickness is only about ¼ to 1/10 of that in the other regions. This non-uniform layer build-up can be only partly remedied with special anode geometries. This means a further mechanical reworking is necessary.

With the production of thick layers there is furthermore the risk that corner bridges with enclosed cavities are formed, as a result of which the mould becomes unusable. A further disadvantage of electrolytic dip-coating is that the external surfaces of the mould must be covered with a material which is inert towards the electrolytic treatment.

SUMMARY OF THE INVENTION

The present invention is based on the object of proposing a process of the abovementioned type with which the intended dimensions of the mould cavity can be achieved or re-achieved as simply as possible even in strand casting moulds having a mould cavity of polygonal cross-section, without problem zones arising in the corner regions of the mould cavity. Furthermore, the strand casting moulds to be coated should as far as possible remain unchanged in their external dimensions.

With the process according to the invention, in which the electrolyte flows in a hydrodynamically controllable manner through the mould cavity of the strand casting mould which forms the cathode, using an insoluble anode, the electrolyte alone supplying the coating material, it is possible to apply both a thin layer of the wear-resistant material with dimensional accuracy, without reworking being necessary, and a thick layer (with which at most minimal reworking arises), since the layer build-up is uniform without corner weaknesses. It is a considerable advantage of the process according to the invention that during the electrolytic coating only the internal surfaces of the mould cavity come into contact with the electrolyte and the external surfaces of the strand casting mould therefore do not have to be covered. Furthermore, intermittent anode/cathode pole reversal is also possible, with which a pulsed deposition of the coating material can be achieved and the coating influenced to be more uniform.

It is to be emphasized as a particular advantage that the mechanical properties, such as, for example, the hardness, and in particular also the structural formation of the coating can be kept largely uniform over the entire region. The coating can be achieved more rapidly than with the conventional processes. Gristle formation on the coated surfaces can also be largely prevented.

BRIEF DESCRIPTION OF THE DRAWINGS

The foregoing and other features of the present invention will be more readily apparent from the following detailed description and drawings of illustrative embodiments of the invention where like reference numbers refer to similar elements throughout and in which.

DESCRIPTION OF EMBODIMENTS OF THE INVENTION

Figure 1:
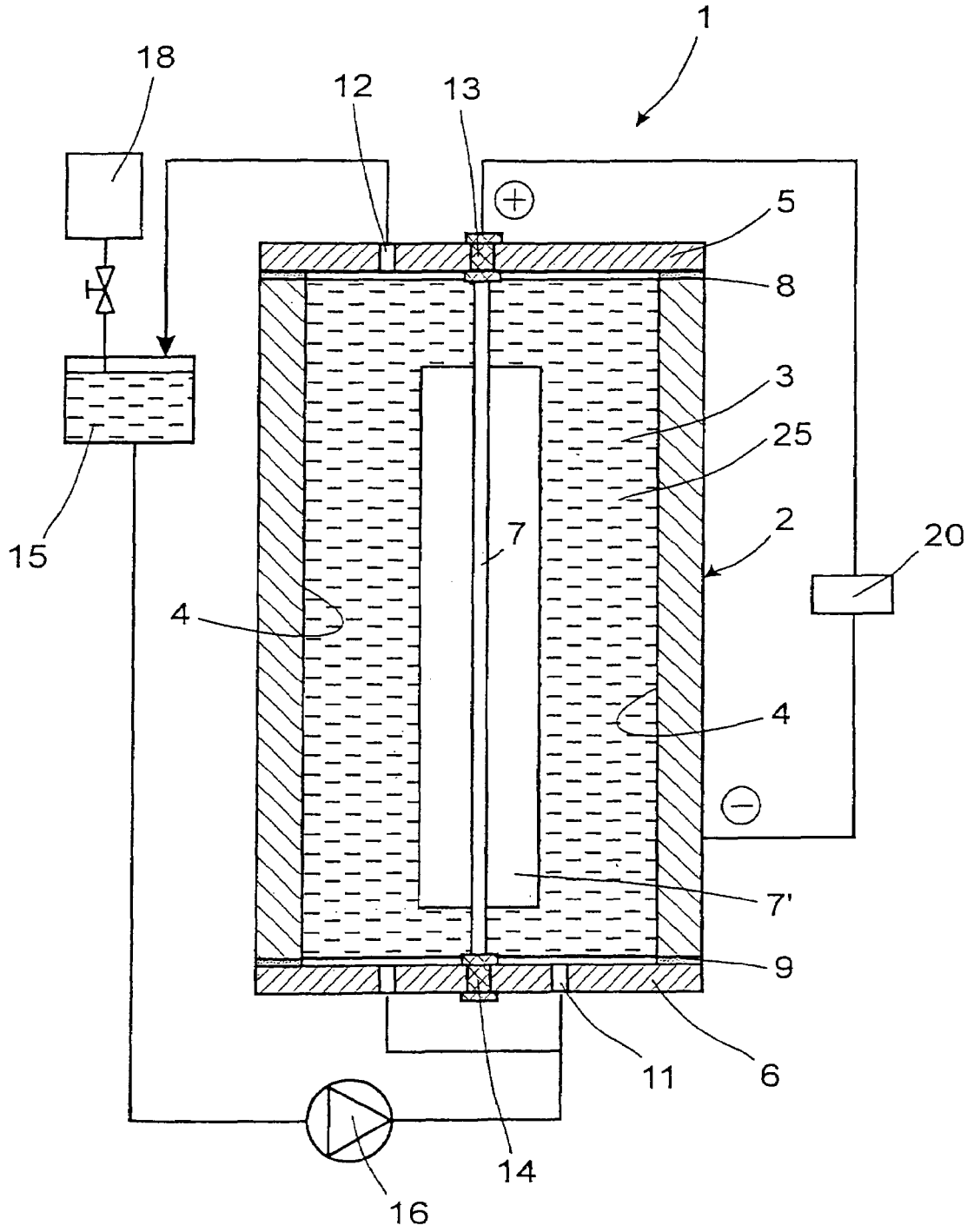
FIG. 1 shows a schematic diagram of the process according to the invention.

FIG. 1 shows, in purely schematic form, a device 1 which is envisaged for electrolytic coating of internal surfaces 4 which demarcate a mould cavity 3 of a strand casting installation 2 with a wear-resistant coating material for the purpose of achieving or re-achieving intended mould cavity dimensions. The mould cavity 3 can have, for example, a rectangular or square cross-section and can thus be demarcated by 4 internal surfaces. However, the mould could also be a mould having another mould cavity cross-section (e.g., circular, polygonal, longitudinally angled) or a so-called dog bone mould.

A head piece and a base piece 5, 6 which are joined to one another via an anode 7 which extends through the mould cavity 3 are assigned to the faces of the strand casting mould 2. Sealing elements 8, 9 on the faces of the strand casting mould 2 seal off the mould cavity 3. The anode 7 is also inserted in a sealing manner in the head piece and base piece 5, 6, cf. seals 13, 14. Both the base piece 6 and the head piece 5 are provided with at least in each case one, preferably with a number of openings 11 and 12 respectively (in FIG. 1 in each case one opening 11, 12 is indicated), which form intake and discharge openings for introducing and discharging an electrolyte 25 envisaged for the electrolytic coating into and out of the otherwise tightly closed mould cavity 3, which forms a reactor space. This is pumped from a reservoir container 15 with the aid of a pump 16 in a hydrodynamically controllable manner into the reactor space from the bottom through the base piece 6 and is fed with an overflow (without pressure) on the head piece back to the reservoir container 15 and to the pump 16. The coating material is metered into the electrolyte 25 as oxide from a container 18.

For the electrolytic coating, the strand casting mould 2, as the cathode, and the anode 7 with the wings 7' indicated can be connected to a direct current source 20 and thereby form a direct current circuit. Either the sealing elements 8, 9 or the seals 13, 14 simultaneously have an electrically insulating action. The anode matches in its cross-section shape the cross-section shape of the mould cavity 3. For polygonal mould cavities, corresponding prismatic anodes are used. The anode is made in particular from a platinum- or mixed ceramic-coated titanium material or from lead. It can also be constructed as a multiple anode. In principle, however, the coating material, such as, for example, copper, nickel or chromium, can also be contained in the anode, in which case it would be provided in a solid or piece form.

The process according to the invention is suitable for application of, for example, layers of copper, nickel or chromium. The coating material is supplied by the electrolyte 25 alone. The anode in itself is insoluble. The anodes can be, for example, platinum-coated anodes of titanium, anodes of lead (Pb) sheet, coated mixed ceramic and other materials. Methanesulfonic acid, cyanide or sulfuric acid electrolyte types can be used as the electrolytes. Using these high-speed electrolytes, with intensive agitation of the electrolyte a current density of 2 to 40 $A/dm^2$ can be achieved. With an efficient hydrodynamic control of the flow of the electrolyte through the reactor space, it is possible to apply both a thin layer of the wear-resistant material with dimensional accuracy, without reworking being necessary, and a thick layer (with which at most minimal reworking arises), since the layer build-up takes place uniformly and without corner weaknesses. The process according to the invention brings considerable advantages in particular in coating with chromium, since precisely in the case of chromium particularly severe corner problems arise during conventional electrolytic coating (layer 5 to 10 times thinner than on the surfaces) and the chromium can be reworked only with grinding.

Pulsed deposition of the coating material can also be achieved with the process according to the invention, in which the electrolyte 25 alone supplies the coating material, since in addition to the hydrodynamic control, an intermittent anode/cathode pole reversal is possible and can influence the coating to be more uniform.

A considerable advantage of the process according to the invention is that during the electrolytic coating only the internal surfaces of the mould cavity come into contact with the electrolyte 25 and the external surfaces of the strand casting mould therefore do not have to be covered.

The anode and/or the strand casting mould could in principle be constructed rotatably about their longitudinal axis, so that rotation during the coating and therefore an improved coating could be rendered possible.

Before the coating, the strand casting mould 2 is cleaned by a rinsing process, in particular a cascade rinsing, which is not explained in more detail as it is known to those in art. It is integrated in a closed system here for the coating and preferably for this rinsing.

The strand casting mould is made from a metallic material or composite material, such as copper, aluminum or nickel, from a plastic or composite plastic or from a ceramic material or other materials.

A rectifier device can furthermore be provided, by means of which the current direction can be reversed for the purpose of achieving a uniform layer application.

If copper is used as the coating material, a commercially available copper oxide, in which the too high chlorine content is reduced by means of a washing/dissolving process as known in the art, is furthermore used beforehand.

Alternatively, the strand casting mould 2 can be coated only in certain regions or more thickly, i.e., with a larger layer thickness, in these regions where a relatively higher degree of wear occurs during operation, for example in the region of the bath surface, where additional wear occurs in particular due to the covering material. An efficient coating is thus achieved. Such a partial coating can be achieved by partial covering of the anode or by insertion of non-conducting screens or by similar measures, as would be understood by those of ordinary skill in the art.

During the coating operation, electromagnetic fields can be generated by magnets, which are not shown in more detail, through which the particles of the coating material can be conducted and led such that a layer of the same thickness as in the other regions is deposited in certain regions, preferably in the edge regions of the strand casting mould. Those of ordinary skill in the art will understand how to generate such electromagnetic fields.

Those skilled in the art will recognize that the materials and methods of the present invention will have various other uses in addition to the above described embodiments. They will appreciate that the foregoing specification and accompanying drawings are set forth by way of illustration and not limitation of the invention. It will further be appreciated that various modifications and changes may be made therein without departing from the spirit and scope of the present invention, which is to be limited solely by the scope of the appended claims.

What is claimed is:

1. Process for electrolytically coating a mould in which internal surfaces thereof demarcate a mould cavity having a generally rectangular cross-sectional shape when viewed in an axial direction, comprising:

a. positioning an electrode in the mould cavity; whereby the electrode comprises an insoluble electrode having a same cross-sectional shape as the cross-sectional shape of the mould, b. sealing off the entire mould cavity with a head piece and a base piece positioned externally to said mould cavity with sealing elements on both front faces at the ends of the mould, whereby the head piece and the base piece each have at least one opening forming an intake and a discharge opening for introducing and discharging electrolyte, c. providing an electrical connection between the electrode and the mould;

d. pumping electrolyte by a pump into the mould cavity and back to the pump, wherein the electrolyte is a sole supply of coating material;

e. providing a current between the electrode and the mould cavity; and f. changing the current direction periodically, wherein the current-direction is changed intermittently to pulse deposit the coating material, and, g. coating the mould cavity over its entire length at one time with a substantially uniform thickness including the four corner regions of the mould cavity.

2. Process according to claim 1, wherein a rectifier device having a pole-changing function changes the current direction.

3. Process according to claim 1, wherein the coating material is an oxide selected from the group consisting of copper, nickel and chromium.

4. Process according to claim 1, wherein the electrolyte contains at least one of methanesulfonic acid, cyanide, and sulfuric acid.

5. Process according to claim 1, wherein the electrode contains at least one of platinum-coated titanium material, mixed ceramic-coated titanium material, and lead.

6. Process according to claim 1, wherein the electrode is a multiple electrode.

7. Process according to one of claim 1, wherein at least one of the electrode and the mould is rotatable around a longitudinal axis during coating.

8. Process according to one of claim 1, further comprising cleaning the mould by a rinsing process prior to coating.

9. Process according to one of claim 8, wherein the rinsing process comprises cascade rinsing.

10. Process according to one of claim 1, wherein the mould is integrated into a closed system.

11. Process according to claim 1, wherein the mould comprises a metallic material.

12. Process according to claim 11, wherein the metallic material is selected from the group consisting of copper, aluminum and nickel.

13. Process according to claim 1, wherein the mould comprises a composite material.

14. Process according to claim 13, wherein the composite material is selected from the group consisting of plastic, composite plastic and ceramic material.

15. Process according to claim 3, further comprising reducing chlorine content in the copper oxide by a washing/dissolving process prior to coating.

16. Process according to claim 1, wherein the mould cavity has a square cross section.

* * * * *